US012723820B2

(12) United States Patent
Lee et al.

(10) Patent No.: US 12,723,820 B2
(45) Date of Patent: Sep. 1, 2026

(54) HEAT EXCHANGER

(71) Applicant: Hanon Systems, Daejeon (KR)

(72) Inventors: Won Taek Lee, Daejeon (KR); Sung Hong Shin, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 230 days.

(21) Appl. No.: 18/274,239

(22) PCT Filed: Feb. 15, 2022

(86) PCT No.: PCT/KR2022/002214
§ 371 (c)(1),
(2) Date: Jul. 26, 2023

(87) PCT Pub. No.: WO2022/177265
PCT Pub. Date: Aug. 25, 2022

(65) Prior Publication Data

US 2024/0085117 A1 Mar. 14, 2024

(30) Foreign Application Priority Data

Feb. 16, 2021 (KR) ..... 10-2021-0020527
Feb. 14, 2022 (KR) ..... 10-2022-0018691

(51) Int. Cl.
*F28D 9/00* (2006.01)
*F28F 9/00* (2006.01)

(52) U.S. Cl.
CPC ..... *F28D 9/005* (2013.01); *F28F 9/002* (2013.01); *F28F 2275/04* (2013.01); *F28F 2275/20* (2013.01)

(58) Field of Classification Search
CPC ..... F28D 2021/007; F28D 2021/0084; F28D 9/005; F28F 9/002; F28F 9/0246;
(Continued)

(56) References Cited

U.S. PATENT DOCUMENTS 5,927,394 A 7/1999 Mendler et al.
2005/0268645 A1* 12/2005 Kent ..... F28F 9/0246 62/509

(Continued)

FOREIGN PATENT DOCUMENTS

CN 106711533 5/2017
CN 107816476 A 3/2018

(Continued)

OTHER PUBLICATIONS

English translation WO 2014132602A1 (Year: 2014).*

(Continued)

*Primary Examiner* — Tho V Duong
(74) *Attorney, Agent, or Firm* — NORTON ROSE FULBRIGHT US LLP

(57) ABSTRACT

An object of the present invention is to provide a heat exchanger that is structurally coupled to an endplate without a process of welding a connection member. To achieve the above-mentioned object, a heat exchanger according to the present invention may include a plurality of main plates each including a through-hole through which a heat exchange medium flows, and an outer wall formed at a periphery thereof, the plurality of main plates being stacked to constitute a heat exchanger core having a flow path formed therein, an endplate being in surface contact with the main plate disposed at an outermost side of the heat exchanger core, the endplate having one or more connection holes, and a connection member configured to be connected to an external component and at least partially inserted into the connection hole.

15 Claims, 7 Drawing Sheets

(58) Field of Classification Search
CPC ..... F28F 2275/04; F28F 2275/10; F28F 2275/20; F28F 2280/04; F28F 2280/06
See application file for complete search history.

(56) References Cited

U.S. PATENT DOCUMENTS

| | | | | |
|---|---|---|---|---|
| 2012/0097365 | A1* | 4/2012 | Papoulis | F28D 9/0056 165/61 |
| 2016/0010929 | A1* | 1/2016 | Takahashi | F28D 9/02 165/166 |
| 2017/0097179 | A1* | 4/2017 | Martin | F25B 39/00 |
| 2021/0033349 | A1 | 2/2021 | Choi et al. | |

FOREIGN PATENT DOCUMENTS

| | | | | |
|---|---|---|---|---|
| DE | 112017002856 | T5 * | 2/2019 | F28F 3/04 |
| FR | 2979698 | A1 * | 3/2013 | F28F 9/0075 |
| JP | H0499133 | U | 8/1992 | |
| JP | H0635049 | B2 | 5/1994 | |
| KR | 20090070758 | A | 7/2009 | |
| KR | 20170079223 | A | 7/2017 | |
| KR | 101937848 | B1 | 1/2019 | |
| KR | 20200000657 | A * | 1/2020 | F28F 9/26 |
| WO | WO-2014132602 | A1 * | 9/2014 | F28F 9/02 |

OTHER PUBLICATIONS

International Search Report issued in PCT/KR2022/002214 on May 16, 2022.
Office Action issued on Jul. 11, 2024 by the German Patent Office in the corresponding Patent Application No. DE 11 2022 000 411.8, with English translation.
English translation of Official Action issued Feb. 28, 2026 in related Chinese Patent Application No. 202280014707.0, 12 pgs.

* cited by examiner (a)

(b)

(a)

(b)

HEAT EXCHANGER

CROSS REFERENCE TO RELATED APPLICATIONS

This patent application is a national phase under 35 U.S.C. § 371 of International Patent Application No. PCT/KR2022/002214 filed Feb. 15, 2022, which claims the benefit of priority from Korean Patent Application Nos. 10-2021-0020527 filed Feb. 16, 2021, and 10-2022-0018691 filed Feb. 14, 2022, each of which is hereby incorporated herein by reference in its entirety for all purposes.--

TECHNICAL FIELD

The present invention relates to a heat exchanger, and more particularly, to a heat exchanger having a structure in which a connection member, which connects the heat exchanger to an external component or fixes the external component to the heat exchanger, is fixed in position without a separate welding process.

BACKGROUND ART

In general, a heat exchanger refers to a device designed to allow two or more fluids to exchange heat with one another. The heat exchanger is used to allow different fluids to exchange heat with one another so that the fluids are cooled or heated. Representatively, the heat exchanger is applied to a vehicle cooling/heating system, a refrigerator, an air conditioner, and the like.

In general, a plate-shaped heat exchanger, which is applied to the vehicle cooling/heating system, has a passageway formed between plates each having a predetermined thickness so that a fluid flows through the passageway. The plate-shaped heat exchanger is characterized in that a plurality of plates is disposed at predetermined intervals so that different fluids alternately flow through passageways between the plurality of plates.

With reference to Korean Patent Application Laid-Open No. 10-2020-0000657, as illustrated in FIG. 1, a water-cooled condenser 1 includes a condensation region 20 in which a plurality of first plates and a plurality of second plates are alternately stacked, and a refrigerant is introduced and condensed, a supercooling region 30 in which the plurality of first plates and the plurality of second plates are alternately stacked, and the refrigerant is supercooled, a connection plate 40 provided between the condensation region 20 and the supercooling region 30, and a receiver dryer 50 positioned on the connection plate 40.

In the related art, a component such as a bushing B is coupled to an outermost peripheral plate in the condensation region or the supercooling region and fixes a water-cooled condenser or other components. The bushing B is primarily and temporarily welded to the plate to be fixed in position before a brazing process is performed on the condensation region and the supercooling region, and then the bushing B is secondarily welded while or after the brazing process is performed on the condensation region and the supercooling region.

That is, in the related art, an assembling-fixing jig for temporary welding or position fixing needs to be used before a core brazing process at the time of coupling a structure, such as the bushing B or a bracket, to the plate. Further, a separate welding-fixing process is required after the core brazing process. For this reason, there is a problem in that the entire assembling process time is lengthened.

Document of Related Art

Patent Document

Patent Document 1 Korean Patent Application Laid-Open No. 10-2020-0000657 published on Jan. 3, 2020.

DISCLOSURE

Technical Problem

The present invention has been made in an effort to solve the above-mentioned problem, and an object of the present invention is to provide a heat exchanger that is structurally coupled to an endplate without a process of welding a connection member.

Technical Solution

To achieve the above-mentioned object, the present invention provides a heat exchanger including: a plurality of main plates each including a through-hole through which a heat exchange medium flows, and an outer wall formed at a periphery thereof, the plurality of main plates being stacked to constitute a heat exchanger core having a flow path formed therein; an endplate being in surface contact with the main plate disposed at an outermost side of the heat exchanger core, the endplate having one or more connection holes; and a connection member configured to be connected to an external component and at least partially inserted into the connection hole.

Further, a first screw thread may be formed in the connection member.

Further, the endplate may include a protruding portion protruding to the outside of the endplate while defining a periphery of the connection hole, and at least a part of one side of the connection member may be exposed to the outside, and the first screw thread may be formed in the connection member.

In this case, the protruding portion may be formed by bending the endplate outward by burring processing.

In this case, the connection member may have a head portion and a column portion, the first screw thread may be formed in the head portion, and a diameter of the head portion may be larger than a diameter of the column portion and a diameter of the connection hole.

In addition, the column portion may be fixed by being fitted with the connection hole.

When the connection member is inserted into the connection hole, a portion between the main plate and a lower surface of the column portion and a portion between an inner peripheral surface of the connection hole and a lateral surface of the column portion may each define a cladding surface, and the connection member may be formed to be coupled to the connection hole, the main plate, and the endplate by a brazing process.

In addition, at least a part of the connection member may be in contact with an inner peripheral surface of the protruding portion.

In addition, the protruding portion may include: a first extension portion bent and extending while protruding to the outside of the endplate; a second extension portion bent and extending again toward a center of the connection hole; a first hole having a periphery defined by the first extension portion; and a second hole having a periphery defined by the second extension portion.

Further, an inner surface of the second extension portion, which is adjacent to the main plate, may be in contact with at least a part of the connection member.

In addition, the connection member may include: a large-diameter portion having a relatively large outer diameter; and a small-diameter portion having a relatively small outer diameter, a diameter of the connection hole may be smaller than the outer diameter of the large-diameter portion and larger than the outer diameter of the small-diameter portion, and one side of the large-diameter portion may be in contact with the main plate, and a part of the small-diameter portion may penetrate the connection hole and protrude to the outside.

Further, a length of the protruding portion may be equal to or larger than a height of the connection member, such that the entire connection member is inserted into the first hole.

In this case, a diameter of the connection member may be larger than a diameter of the second hole, and an upper surface of the connection member may be in surface contact with a lower surface of a portion of the protruding portion that defines the first hole.

In addition, the second hole may further include a second screw thread formed on an inner peripheral surface thereof and provided at a position corresponding to the first screw thread.

Further, the main plate disposed at the outermost side of the heat exchanger core may further include a third screw thread formed at a position corresponding to the first screw thread.

Further, the endplate and the connection member may be made of the same type of metallic material and welded to each other during a brazing process.

In a water-cooled condenser according to the present invention, a coolant may flow in the heat exchanger core, the heat exchanger may further include: a receiver dryer; and a connector configured to connect the heat exchanger core and the receiver dryer, and the connection member may be coupled to the endplate disposed at a side opposite to a side at which the receiver dryer is installed.

Advantageous Effects

With the above-mentioned configuration, the heat exchanger according to the present invention may exclude a separate welding process of attaching the connection member to the endplate, which may minimize the order and time of the entire assembling process. Because the connection member of the heat exchanger may be fixed in position autonomously, an external mechanism for fixing the position may not be used. Further, the connection member may be seated in a state of being coincident with a seating point or a seating surface, such that the position may be accurately and stably fixed in comparison with a welding process.

DESCRIPTION OF REFERENCE NUMERALS

Figure 1:
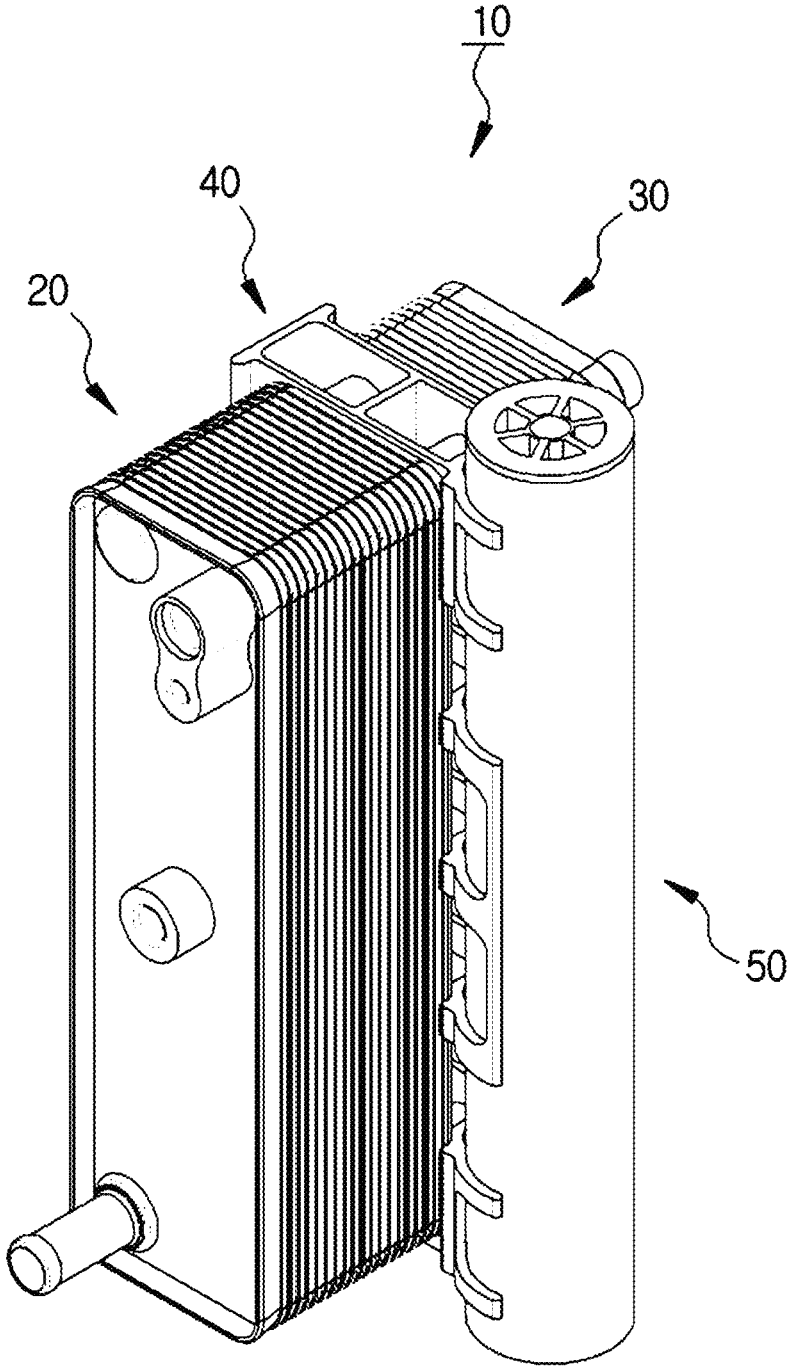
FIG. 1 (Prior Art)
FIG. 1 is a perspective view of a water-cooled condenser in the related art.

1000: Heat exchanger, Water-cooled condenser
1100: Heat exchanger core
1200: Receiver dryer
1300: Connector
100: Main plate
101: Flat plate
102: Through-hole
103: Outer wall
110: Third screw thread
200: Endplate
210: Connection hole
210*a*: First hole
210*b*: Second hole
211*b*: Second screw thread
220: Protruding portion
300: Connection member
301: First screw thread
310: Head portion
320: Column portion
F: Fastening member
BT: Bracket

MODE FOR INVENTION

Hereinafter, the technical spirit of the present invention will be described in more detail using the accompanying drawings. In addition, terms or words used in the specification and the claims should not be interpreted as being limited to a general or dictionary meaning and should be interpreted as a meaning and a concept which conform to the technical spirit of the present invention based on a principle that an inventor can appropriately define a concept of a term in order to describe his/her own invention by the best method.

Therefore, the exemplary embodiments disclosed in the present specification and the configurations illustrated in the drawings are just the best preferred exemplary embodiments of the present invention and do not represent all the technical spirit of the present invention. Accordingly, it should be appreciated that various modified examples capable of substituting the exemplary embodiments may be made at the time of filing the present application.

Hereinafter, the technical spirit of the present invention will be described in more detail using the accompanying drawings. The accompanying drawings are only exemplary embodiments illustrated to explain the technical spirit of the present invention in more detail, and the technical spirit of the present invention is not limited to the form of the accompanying drawings.

Figure 2:
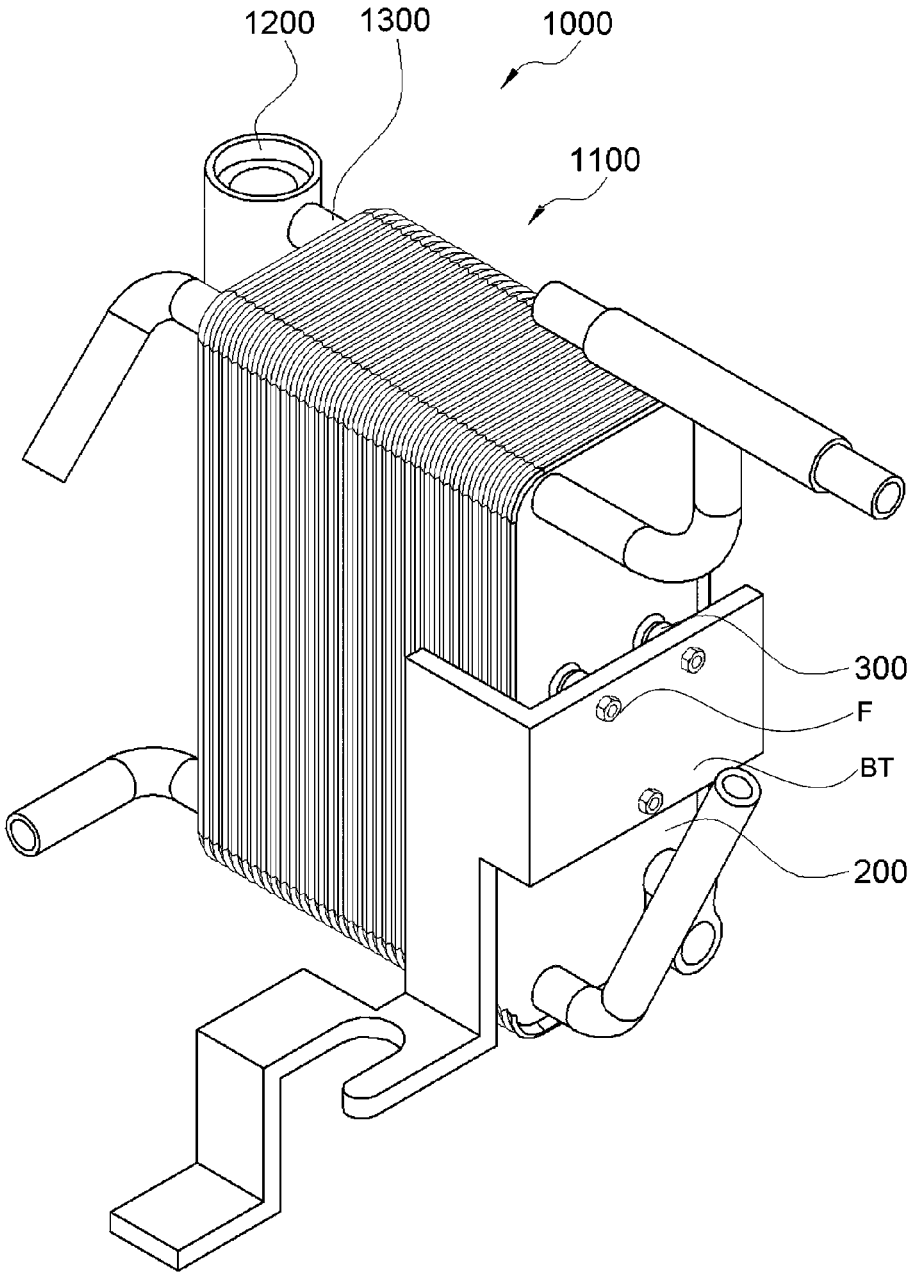
FIG. 2 is a perspective view of a water-cooled condenser according to the present invention.
Figure 3:
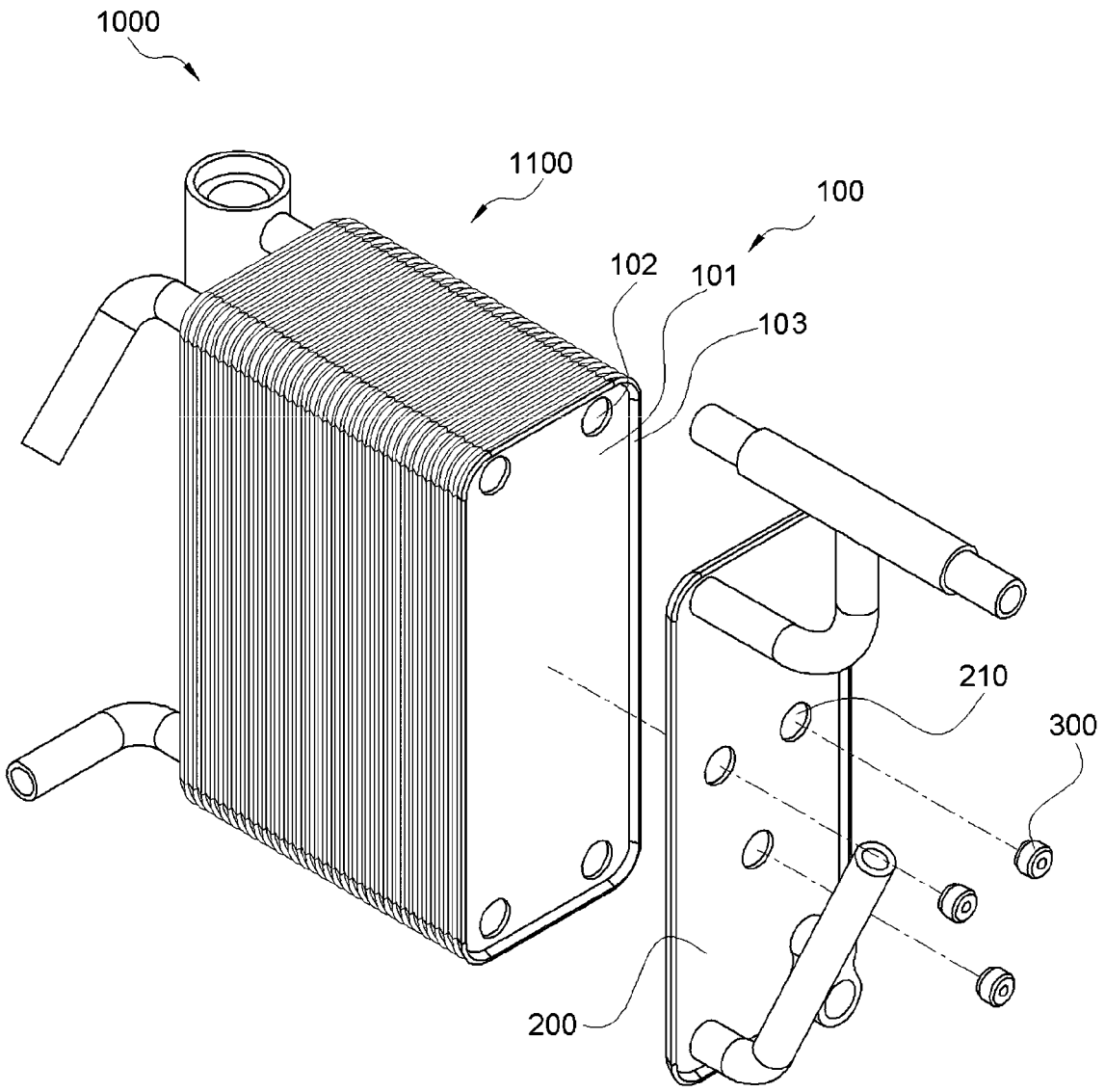
FIG. 3 is a perspective view of a first embodiment of a heat exchanger according to the present invention.

With reference to FIGS. 2 and 3, a heat exchanger 1000 according to the present invention includes: a plurality of main plates 100 each including through-holes 102, through which a heat exchange medium flows, a flat plate 101, and an outer wall 103 formed on a periphery of the flat plate 101, the plurality of main plates 100 being stacked to constitute a heat exchanger core 1100 having flow paths formed therein; an endplate 200 being in surface contact with the main plate 100 disposed at an outermost side of the heat exchanger core 1100, the endplate 200 having one or more connection holes 210; and connection members 300 configured to be connected to an external component and at least partially inserted into the connection holes 210.

The main plate 100 includes the one or more through-holes 102 formed in the flat plate 101 and includes the outer wall 103 formed to surround an edge of the flat plate 101, such that the fluid may flow through the flat plate 101 and be introduced or discharged through the through-holes 102. The outer wall 103 may prevent a loss of the fluid. The flat plate 101 is formed in an approximately rectangular shape. The outer wall 103 is formed by bending the edge of the flat plate 101 at a slight inclination angle. The fluid may be introduced on a layer, which is defined by the flat plate 101, through the through-hole 102, and the fluid having flown on the layer, which is defined by the flat plate 101, may be discharged to a next layer.

In addition, the plurality of main plates 100 may be alternately stacked to define the flow paths through which the fluid flows. Oil or a coolant may flow through the flow path formed by stacking the plurality of main plates 100. However, the type of fluid is not limited.

The endplate 200 is configured to be in surface contact with the main plate 100 provided at the outermost side of the heat exchanger core 1100 among the plurality of main plates 100 stacked to constitute the heat exchanger core 1100. The endplate 200 has the one or more connection holes 210 into which the connection members 300 may be inserted.

Fastening members F, such as bolts, nuts, or washers, may be fastened to the connection members 300, such that a bracket BT may be fixed. In this case, the bracket BT may be used to connect the heat exchanger to other components such as a valve or a pump. Alternatively, the bracket BT may also be used to fix the heat exchanger to a vehicle body.

The connection member 300 may be fixed in position by being at least partially inserted into the connection hole 210 or both the connection hole 210 and the endplate 200.

With the above-mentioned configuration, the heat exchanger 1000 according to the present invention may exclude a separate welding process of attaching the connection member 300 to the endplate 200, which may minimize the order and time of the entire assembling process. Because the connection member 300 of the heat exchanger 1000 may be fixed in position autonomously, an external mechanism for fixing the position may not be used. Further, the connection member 300 may be seated in a state of being coincident with a seating point or a seating surface, such that the position may be accurately and stably fixed in comparison with a welding process.

Figure 4:
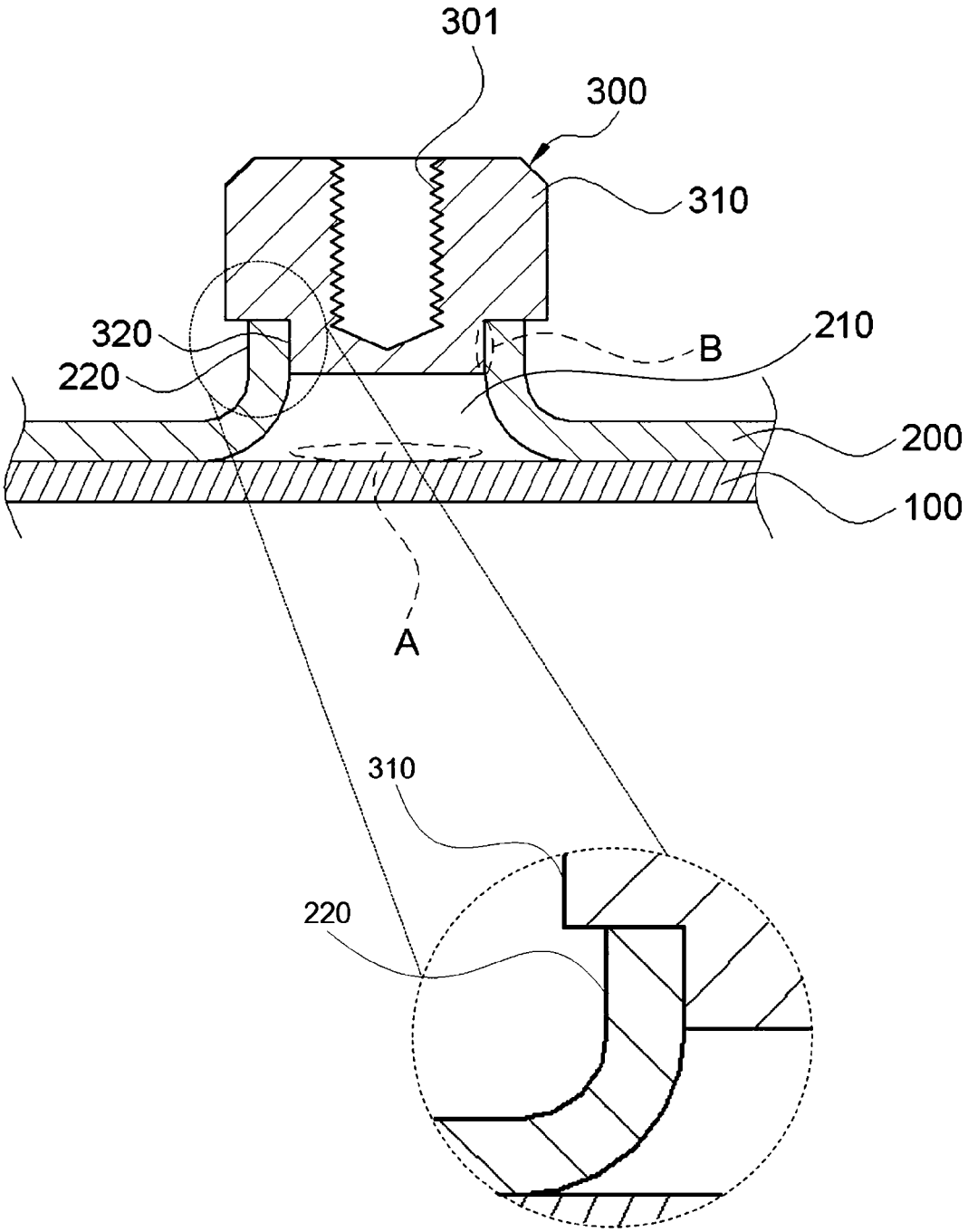
FIG. 4 is a coupled cross-sectional view of the first embodiment of the heat exchanger according to the present invention.

With reference to FIG. 4 illustrating coupled cross-sectional views of the main plate 100, the endplate 200, and the connection member 300 according to the first embodiment, a first screw thread may be formed in the connection member 300, and the fastening member may be fastened to the first screw thread 301.

In addition, the endplate 200 may include a protruding portion 220 protruding to the outside of the endplate 200 while defining a periphery of the connection hole 210. One side of the connection member 300 may be at least partially exposed to the outside, and the first screw thread 301 may be formed in the connection member 300.

The connection hole 210 is formed in a shape that expands to the outside of the endplate 200 in the endplate 200, i.e., a point at which the endplate 200 and the main plate 100 are in surface contact with each other. The protruding portion 220 is provided on the endplate 200 and formed around the connection hole 210. In this case, the protruding portion 220 may be formed by bending the endplate 200 outward by burring processing.

An upper side of the connection member 300 is exposed to the outside, i.e., to the outside of the connection hole 210, and a lower side of the connection member 300 is inserted into the connection hole 210, such that the connection member 300 may be coupled to the endplate 200.

Therefore, a part of the connection member 300 is inserted into the connection hole 210 formed in the endplate 200, such that the position of the connection member 300 may be fixed on the endplate 200. In this case, the connection member 300 may be fixed to the connection hole 210 by compression or press-fitting.

In this case, the connection member 300 has a head portion 310 and a column portion 320. The first screw thread 301 is formed in the head portion 310. A diameter of the head portion 310 may be larger than a diameter of the column portion 320 and a diameter of the connection hole 210.

In case that the head portion 310 of the connection member 300 has a polygonal shape instead of a circular shape, the diameter of the head portion 310 is set to a diameter of a circumscribed circle defined by the head portion 310. The first screw thread 301 may be formed inside the head portion 310. The first screw thread 301 may extend or may not extend inside the column portion 320. Therefore, when the head portion 310 and the column portion 320 of the connection member 300 have different diameters, an error related to an assembling direction may be reduced during a process of fastening the connection member 300 to the connection hole 210, and the first screw thread 301 may be properly fastened toward the outside of the endplate 200, thereby reducing a work error.

In this case, at least a part of the connection member 300 may be in contact with an inner peripheral surface of the protruding portion 220. As a specific example, a lower surface of the head portion 310 may be in surface contact with an upper surface of the protruding portion 220, and the column portion 320 may be externally in contact with at least a part of the protruding portion 220. Therefore, the connection member 300 and the endplate 200 may be more securely coupled, and the connection member 300 is prevented from being inserted into the connection hole 210 than necessary. In addition, a screw thread may also be formed on an outer peripheral surface of the column portion 320, and a screw thread may also be formed on an inner peripheral surface of the connection hole 210, such that the column portion 320 and the connection hole 210 may be screw-coupled.

Figure 5:
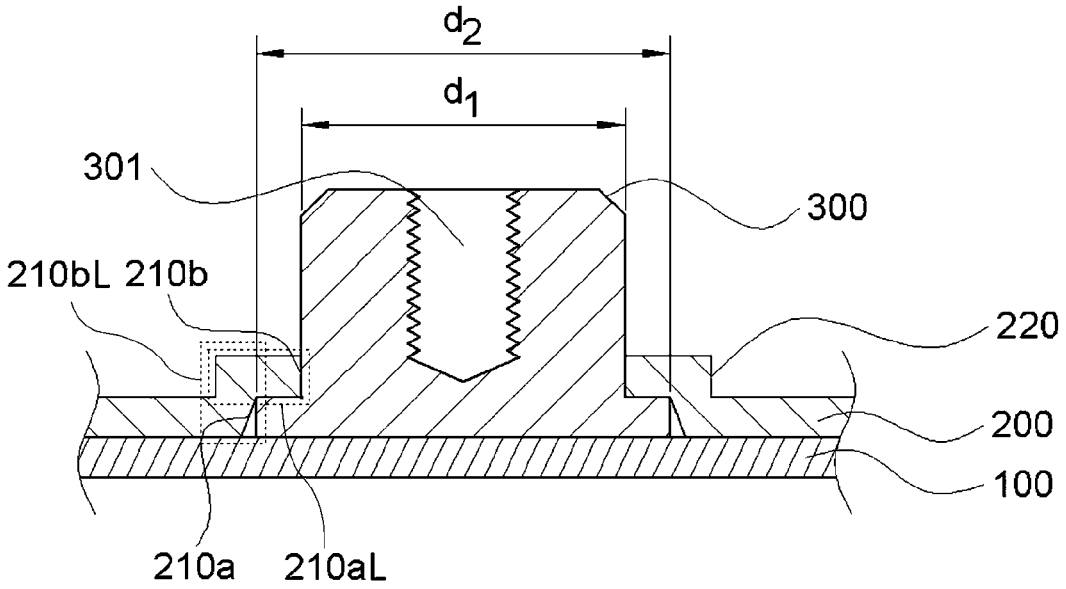
FIG. 5A is a coupled cross-sectional view of a second embodiment of the heat exchanger according to the present invention.
FIG. 5B is a coupled top plan view of the second embodiment of the heat exchanger according to the present invention.
Figure 5:
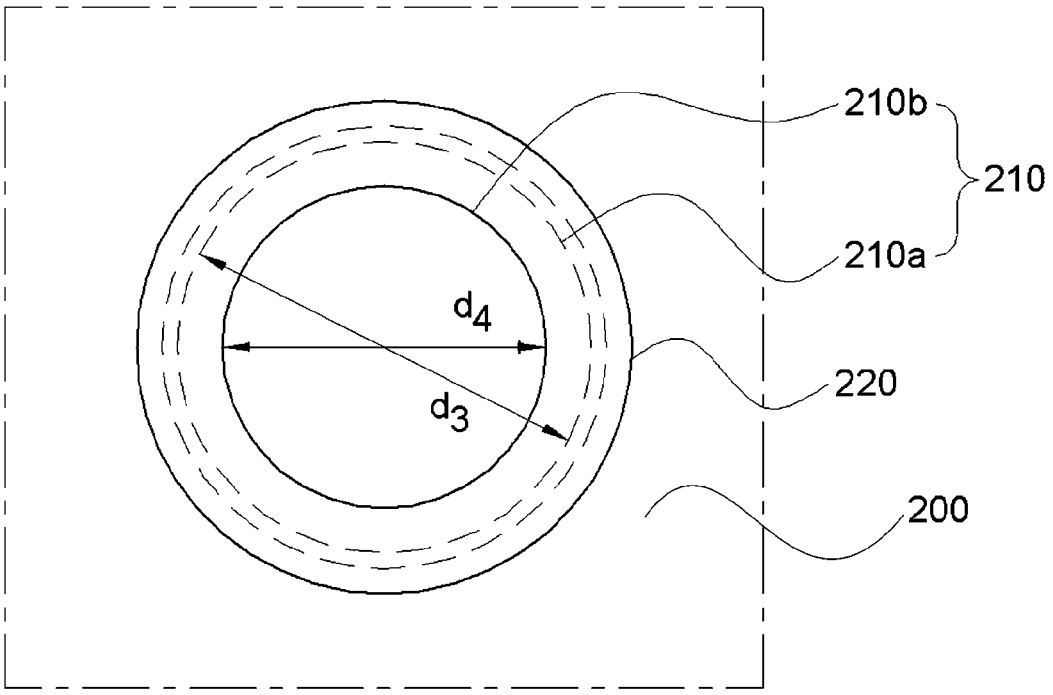

After the connection member 300 inserted into the connection hole 210, a portion A between the main plate 100 and the lower surface of the column portion 320 lower surface and a portion B between the inner peripheral surface of the connection hole 210 and a lateral surface of the column portion 320 each define a cladding surface, such that the connection member 300 may be coupled to the connection hole 210, the main plate 100, and the endplate 200 during the process of brazing the heat exchanger core 1100. With reference to FIG. 5A illustrating coupled cross-sectional views of the main plate 100, the endplate 200, and the connection member 300 according to the second embodiment and FIG. 5B illustrating coupled top plan views of the main plate 100 and the endplate 200 according to the second embodiment, the connection hole 210 includes a first hole 210*a* formed inside the endplate 200, and a second hole 210*b* formed outside the endplate 200, and the protruding portion 220 may connect the first hole 210*a* and the second hole 210*b*. In more detail, the protruding portion 220 includes a first extension portion 210*a*L bent and extending while protruding to the outside of the endplate 200, and a second extension portion 210*b*L bent and extending again toward a center of the connection hole 210. In this case, the first extension portion 210*a*L defines a periphery of the first hole 210*a*, and the second extension portion 210*b*L defines a periphery of the second hole 210*b*. That is, the first hole 210*a* and the second hole 210*b* of the connection hole 210 may be formed to have different diameters by the protruding portion 220, and a cross-section of the protruding portion 220 may have a shape having a stepped portion. In addition, in this case, an inner surface of the second extension portion 210*b*L, which is adjacent to the main plate 100, is formed to be in contact with at least a part of the connection member 300. With the above-mentioned shape, the connection member 300 may not separate through the connection hole 210 after the connection member 300 is stacked between the endplate 200 and the main plate 100. Further, the connection member 300 may be welded by means of the cladding surface during the core brazing process.

In addition, the connection member 300 may include a large-diameter portion having a relatively large outer diameter, and a small-diameter portion having a relatively small outer diameter. The diameter of the connection hole 210 is smaller than the outer diameter of the large-diameter portion and larger than the outer diameter of the small-diameter portion, such that one side of the large-diameter portion may be in contact with the main plate 100, and a part of the small-diameter portion may penetrate the connection hole 210 and protrude to the outside. That is, the connection member 300 is fixedly disposed between the main plate 100 and the endplate 200, but the entire connection member 300 is not necessarily disposed only between the main plate 100 and the endplate 200. A part of the small-diameter portion may protrude to the outside.

That is, a diameter of the upper side of the connection member 300 may be equal to a diameter of the second hole 210*b*, such that a part or the entirety of the upper side of the connection member 300 may be inserted into the second hole 210*b*. A diameter of the lower side of the connection member 300 may be larger than the diameter of the second hole 210*b* and equal to or smaller than a diameter of the first hole 210*a*, such that the lower side of the connection member 300 may be inserted into the second hole 210*b*. Therefore, the lower side of the connection member 300 may be fixed in position by the protruding portion 220 formed by the first hole 210*a* and the second hole 210*b* so that the connection member 300 is not separated from the first hole 210*a* and the second hole 210*b*.

Figure 6:
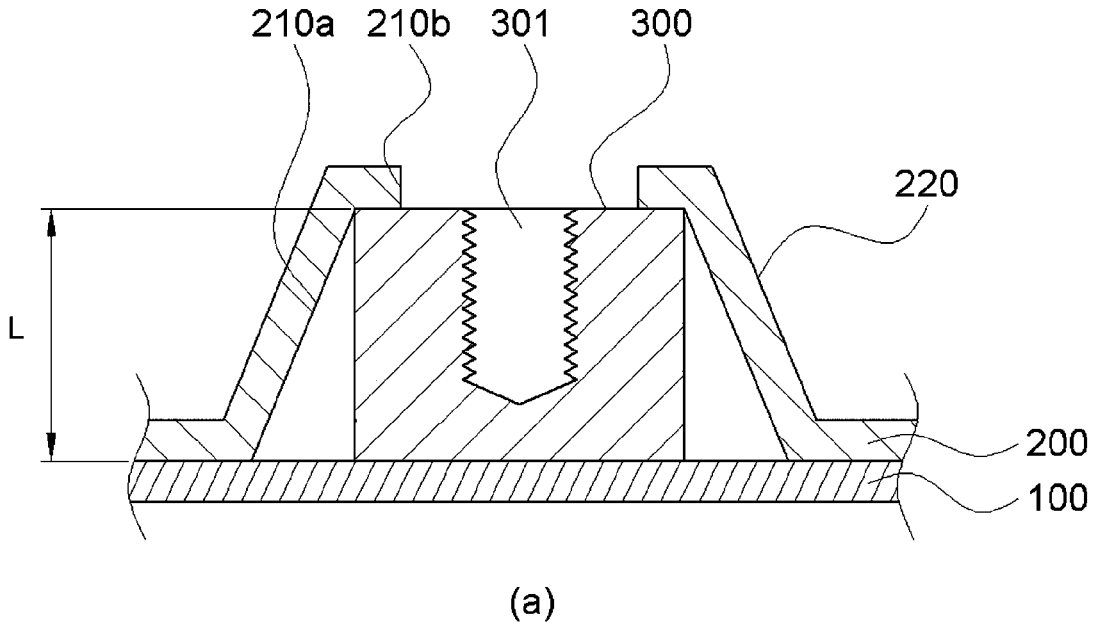
FIG. 6A is a coupled cross-sectional view of a third embodiment of the heat exchanger according to the present invention.
FIG. 6B is a cross-sectional view of a connection member of the third embodiment of the heat exchanger according to the present invention.
Figure 6:
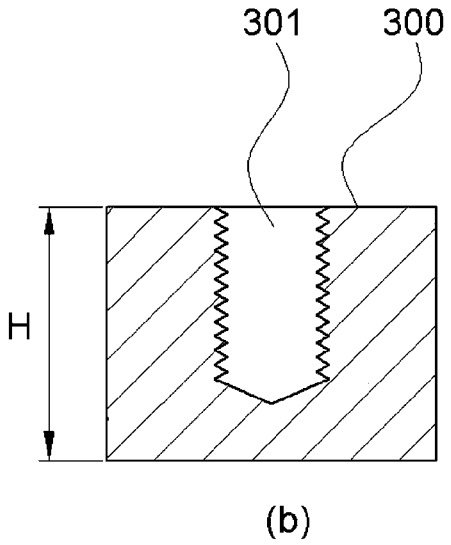

With reference to FIG. 6A illustrating coupled cross-sectional views of the main plate 100, the endplate 200, and the connection member 300 according to the third embodiment and FIG. 6B illustrating a cross-sectional view of the connection member 300 according to the second embodiment, a length L of the protruding portion 220 may be equal to or larger than a height H of the connection member 300, such that the entire connection member 300 may be inserted into the first hole 210*a*.

The first hole 210*a* protrudes to the outside of the endplate 200 so as to have a predetermined height L, and an overall height H of the connection member 300 is equal to or smaller than the length L of the first hole 210*a*, such that the entire connection member 300 may be inserted into the first hole 210*a*. That is, the protruding portion 220 may protrude to the outside of the endplate 200 by a predetermined height so that the first hole 210*a* may be formed in a cylindrical shape having the predetermined height. In this case, a space defined by the first hole 210*a* may have a cylindrical shape having upper and lower portions having the same diameter or a cylindrical shape having upper and lower portions having different diameters. In this case, the diameter of the first hole 210*a* may be set to a diameter of a circle having the smallest diameter in the space defined by the first hole 210*a*.

An overall height of the connection member 300 is equal to or smaller than a height of the first hole 210*a*, such that the connection member 300 may be inserted into the space defined by the first hole 210*a*, and the position of the connection member 300 may be limited or fixed in a direction parallel to a length or width direction of the endplate 200.

In this case, the diameter of the connection member 300 may be larger than the diameter of the second hole 210*b*, and the upper surface of the connection member 300 may be in surface contact with a lower surface of a portion of the protruding portion 220 that defines the first hole 210*a*. Therefore, the position of the connection member 300 may be limited or fixed even in a direction perpendicular to the length or width direction of the endplate 200.

Furthermore, when the height of the connection member 300 is equal to the height of the first hole 210*a* and the diameter of the connection member 300 is equal to the diameter of the first hole 210*a*, the connection member 300 may be fitted with the space defined by the first hole 210*a*, such that the position of the connection member 300 may be fixed in the directions perpendicular and parallel to the length or width direction of the endplate 200.

Figure 7:
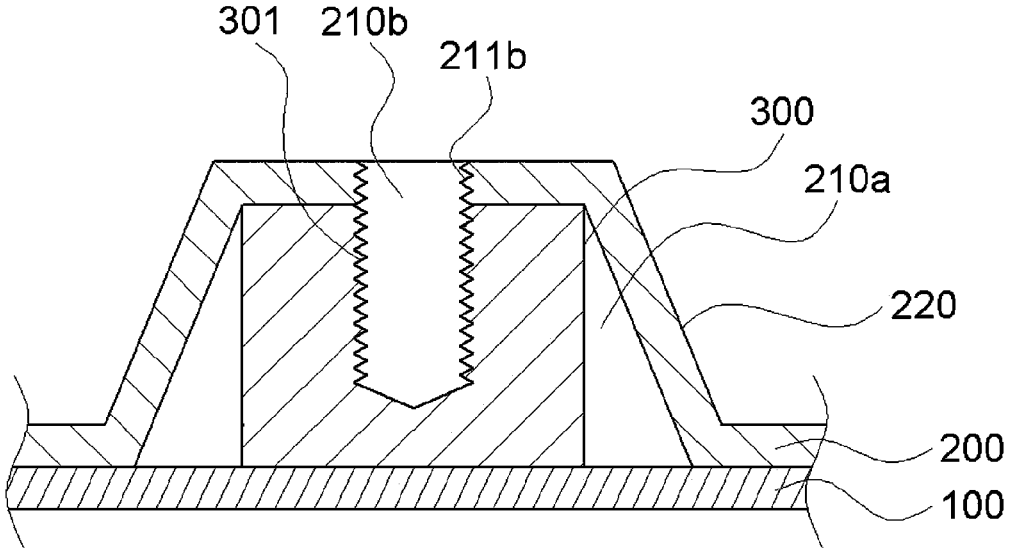
FIG. 7A is a coupled cross-sectional view of a fourth embodiment of the heat exchanger according to the present invention.
FIG. 7B is a coupled cross-sectional view of a fifth embodiment of the heat exchanger according to the present invention.
Figure 7:
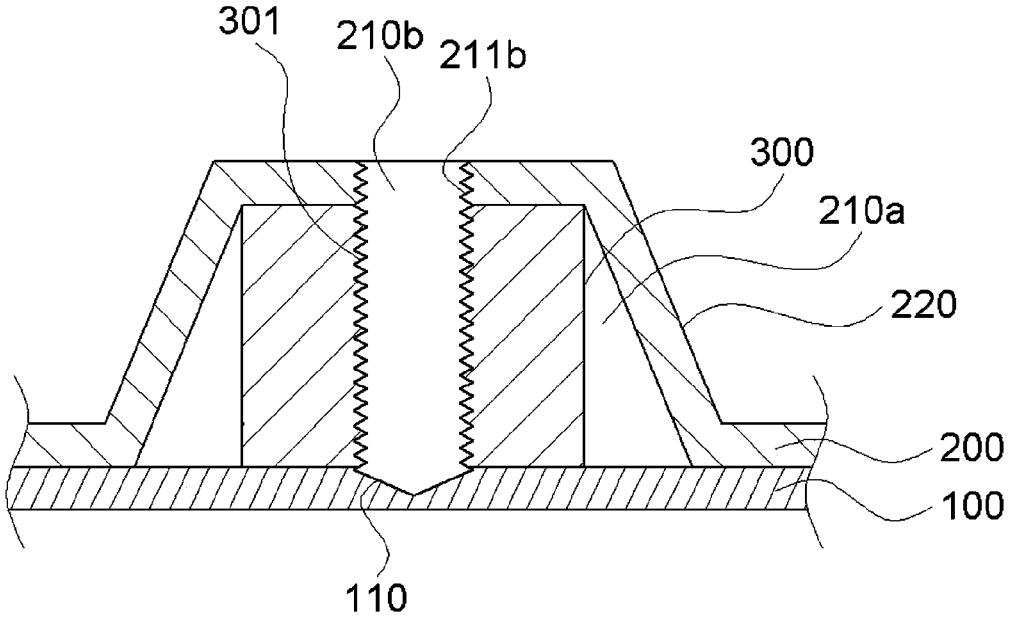

With reference to FIG. 7A illustrating coupled cross-sectional views of the main plate 100, the endplate 200, and the connection member 300 according to the fourth embodiment, the second hole 210*b* may further include a second screw thread 211*b* formed on an inner peripheral surface of the second hole 210*b* and provided at a position corresponding to the first screw thread 301. That is, the second screw thread 211*b* is formed on the inner peripheral surface of the second hole 210*b* while having the same diameter and center as the first screw thread 301. Therefore, the first screw thread 301 and the second screw thread 211*b* may be configured as screw threads connected to each other.

In case that the second screw thread 211*b* is also formed on the inner peripheral surface of the second hole 210*b*, the first screw thread 301 may have a shorter length than when the screw thread is formed only in the connection member 300. Therefore, the overall length of the connection member 300 may be shortened, and the entire package for connecting an external structure to the heat exchanger 1000 may be miniaturized. In addition, the external structure may be coupled not only to the connection member 300 but also to the endplate, thereby increasing a coupling force.

With reference to FIG. 7B illustrating coupled cross-sectional views of the main plate 100, the endplate 200, and the connection member 300 according to the fifth embodiment, the heat exchanger according to the present invention may further include a third screw thread 110 formed in the main plate 100 provided at the outermost side of the heat exchanger core 1100, and the third screw thread 110 is formed at a position corresponding to the first screw thread 301. That is, the third screw thread 110 may have the same diameter and center as the first screw thread 301 and have a shape formed by extending the first screw thread 301. More specifically, the main plate 100, which is provided at the outermost side of the heat exchanger core 1100, may have the third screw thread 110 that has the same diameter and center as the first screw thread 301 and has a groove shape that is not formed through the main plate 100. A fastening start end of a fastening bolt may be fastened to the third screw thread 110. In case that the third screw thread 110 is formed in the main plate 100 provided at the outermost side of the heat exchanger core 1100, the first screw thread 301 may have a shorter length than when the screw thread is formed only in the connection member 300 or when the second screw thread 211*b* is further formed. Therefore, the overall length of the connection member 300 may be shortened, and the entire package for connecting the external structure to the heat exchanger 1000 may be miniaturized. In addition, the external structure may be coupled not only to the connection member 300 but also to the main plate 100, thereby increasing a coupling force.

In addition, the endplate 200 and the connection member 300 may be made of the same type of metallic material and welded to each other during the process of brazing the heat exchanger core 1100. That is, because the endplate 200 and the connection member 300 are made of the same metallic material, the endplate 200 and the connection member 300 may be welded to each other during the brazing process of joining the heat exchanger core 1100. For example, when the endplate 200 is also made of aluminum, the connection member 300 is also made of aluminum, such that the endplate 200 and the connection member 300 may be welded during the process of brazing the heat exchanger core 1100.

With reference to FIGS. 2 and 3, the water-cooled condenser according to the present invention, a coolant may flow through the heat exchanger core 1100, and the heat exchanger 1000 may further include a connector 1300 that connects the receiver dryer 1200, the heat exchanger core 1100, and the receiver dryer 1200. The connection member 300 may be coupled to the endplate 200 disposed at a side opposite to the side at which the receiver dryer 1200 is installed.

The connection member 300 may be coupled to the endplate 200 disposed at the side opposite to the side at which the receiver dryer 1200 is installed, such that the external structure connected to the water-cooled condenser does not interfere with the receiver dryer 1200.

The heat exchanger core 1100 may include a flow path through which the coolant flows, and a flow path through which a fluid, which is different from the coolant, flows, i.e., a flow path through which a refrigerant flows. The water-cooled condenser may further include a condensation region in which a refrigerant is condensed as the refrigerant and the coolant exchange heat with each other. In this case, the receiver dryer 1200 may separate the gaseous refrigerant and the liquid refrigerant from the condensed refrigerant.

In addition, the water-cooled condenser may further include a supercooling region in which the refrigerant is supercooled as the coolant and the refrigerant passing through the receiver dryer 1200 exchange heat with each other.

The connector 1300 connects and fixes the heat exchanger core 1100 and the receiver dryer 1200 that form the condensation region and the supercooling region.

The present invention is not limited to the above embodiments, and the scope of application is diverse. Of course, various modifications and implementations are possible without departing from the subject matter of the present invention claimed in the claims.

INDUSTRIAL APPLICABILITY

According to the present invention, the connection member, which connects the heat exchanger to the external component or fixes the external component to the heat exchanger, may be fixed in position without a separate welding process, which may reduce the number of manufacturing processes during a process of manufacturing the heat exchanger, thereby improving the productivity and economic feasibility.

What is claimed is:

1. A heat exchanger comprising:

a plurality of main plates each including a through-hole through which a heat exchange medium flows, and an outer wall formed at a periphery thereof, the plurality of main plates being stacked to constitute a heat exchanger core having a flow path formed therein;

an endplate being in surface contact with the main plate disposed at an outermost side of the heat exchanger core, the endplate having one or more connection holes; and a connection member configured to be connected to an external component and at least partially inserted into the connection hole, wherein the endplate comprises a protruding portion which is formed by bending a portion of the end plate outward, wherein a first screw thread is formed in the connection member, wherein an inner side of the connection hole is closed off by the main plate, wherein the connection member has a head portion and a column portion, the first screw thread is formed in the head portion, and a diameter of the head portion is larger than a diameter of the column portion and a diameter of the connection hole, and wherein the column portion is inserted from an outer side of the protruding portion, which is the open side of the connection hole, and is fixed by being fitted with the connection hole.

2. The heat exchanger of claim 1, wherein the protruding portion defines a periphery of the connection hole, and wherein at least a part of one side of the connection member is exposed to the outside, and the first screw thread is formed in the connection member.

3. The heat exchanger of claim 2, wherein the protruding portion is formed by bending the endplate outward by burring processing.

4. The heat exchanger of claim 1, wherein when the connection member is inserted into the connection hole, a portion between the main plate and a lower surface of the column portion and a portion between an inner peripheral surface of the connection hole and a lateral surface of the column portion each define a cladding surface, and the connection member is formed to be coupled to the connection hole, the main plate, and the endplate by a brazing process.

5. The heat exchanger of claim 2, wherein at least a part of the connection member is in contact with an inner peripheral surface of the protruding portion.

6. The heat exchanger of claim 2, wherein the protruding portion comprises:

a first extension portion bent and extending while protruding to the outside of the endplate;

a second extension portion bent and extending again toward a center of the connection hole;

a first hole having a periphery defined by the first extension portion; and a second hole having a periphery defined by the second extension portion.

7. The heat exchanger of claim 6, wherein an inner surface of the second extension portion, which is adjacent to the main plate, is in contact with at least a part of the connection member.

8. The heat exchanger of claim 6, wherein the connection member comprises:

a large-diameter portion having a relatively large outer diameter; and a small-diameter portion having a relatively small outer diameter, wherein a diameter of the connection hole is smaller than the outer diameter of the large-diameter portion and larger than the outer diameter of the small-diameter portion, and wherein one side of the large-diameter portion is in contact with the main plate, and a part of the small-diameter portion penetrates the connection hole and protrudes to the outside.

9. The heat exchanger of claim 6, wherein a length of the protruding portion is equal to or larger than a height of the connection member, such that the entire connection member is inserted into the first hole.

10. The heat exchanger of claim 9, wherein a diameter of the connection member is larger than a diameter of the second hole, and an upper surface of the connection member is in surface contact with a lower surface of a portion of the protruding portion that defines the first hole.

11. The heat exchanger of claim 10, wherein the second hole further comprises a second screw thread formed on an inner peripheral surface thereof and provided at a position corresponding to the first screw thread.

12. The heat exchanger of claim 1, wherein the main plate disposed at the outermost side of the heat exchanger core further comprises a third screw thread formed at a position corresponding to the first screw thread.

13. The heat exchanger of claim 1, wherein the endplate and the connection member are made of the same type of metallic material and welded to each other during a brazing process.

14. The heat exchanger of claim 1, wherein a coolant flows in the heat exchanger core, wherein the heat exchanger further comprises:

a receiver dryer; and a connector configured to connect the heat exchanger core and the receiver dryer, and wherein the connection member is coupled to the endplate disposed at a side opposite to a side at which the receiver dryer is installed.

15. A heat exchanger comprising:

a plurality of main plates each including a through-hole through which a heat exchange medium flows, and an outer wall formed at a periphery thereof, the plurality of main plates being stacked to constitute a heat exchanger core having a flow path formed therein;

an endplate being in surface contact with the main plate disposed at an outermost side of the heat exchanger core, the endplate having one or more connection holes; and a connection member configured to be connected to an external component and at least partially inserted into the connection hole, wherein a first screw thread is formed in the connection member, and the first screw thread is formed in a direction parallel to the direction in which the connection member is inserted into the connection hole, wherein an inner side of the connection hole is closed off by the main plate, wherein the connection member has a head portion and a column portion, the first screw thread is formed in the head portion, and a diameter of the head portion is larger than a diameter of the column portion and a diameter of the connection hole, and wherein the column portion is inserted from an outer side of a protruding portion of the end plate, which is the open side of the connection hole, and is fixed by being fitted with the connection hole.

* * * * *